US006668514B2

(12) United States Patent
Skov

(10) Patent No.: US 6,668,514 B2
(45) Date of Patent: Dec. 30, 2003

(54) APPARATUS AND METHOD FOR CONNECTING ADJACENT PANELS

(75) Inventor: Erik L. Skov, Akron, OH (US)

(73) Assignee: Rubbermaid Incorporated, Wooster, OH (US)

( * ) Notice: Subject to any disclaimer, the term of this patent is extended or adjusted under 35 U.S.C. 154(b) by 0 days.

(21) Appl. No.: 10/082,608

(22) Filed: Feb. 25, 2002

(65) Prior Publication Data

US 2002/0170242 A1 Nov. 21, 2002

Related U.S. Application Data

(63) Continuation-in-part of application No. 09/860,381, filed on May 18, 2001.

(51) Int. Cl.[7] ..... E04C 2/00; E04C 2/54

(52) U.S. Cl. ..... 52/782.1; 52/79.5; 52/578; 52/582.1; 52/586.1; 52/592.1; 52/588.1; 403/298; 403/294; 403/331

(58) Field of Search ..... 52/79.5, 782.1, 52/578, 581, 582.1, 220.5, 220.7, 586.1, 591.5, 592.1, 471, 465, 588.1, 584.1; 403/298, 294, 381, 363, 364, 331

(56) References Cited

U.S. PATENT DOCUMENTS

| | | | | |
|---|---|---|---|---|
| 603,147 A | | 4/1898 | Lordly | 189/36 |
| 2,079,635 A | | 5/1937 | Sharp | 189/34 |
| 2,270,161 A | | 1/1942 | Briggs | 189/2 |
| 2,981,383 A | | 4/1961 | Dunn | 189/36 |
| 3,070,646 A | | 12/1962 | Lindgren | 174/35 |
| 3,206,902 A | * | 9/1965 | Turnbull et al. | 52/582.1 |
| 3,363,383 A | * | 1/1968 | Barge | 52/471 |

(List continued on next page.)

FOREIGN PATENT DOCUMENTS

| | | |
|---|---|---|
| CH | 396 368 | 1/1966 |
| DE | 26 43 270 A1 | 3/1978 |
| DE | 34 18687 A1 | 11/1985 |
| DE | 8913507.5 | 3/1990 |
| DE | 3843151 | 7/1990 |

(List continued on next page.)

OTHER PUBLICATIONS

International Search Report for PCT/US02/15630 dated Sep. 20, 2002.

"item Industrietechnik" promotional materials, bearing a designation 0.4.106.31 05/95 (13 pages).

PCT Partial International Search Report issued in PCT/US03/05414, Jun. 27, 2003.

*Primary Examiner*—Carl D. Friedman
*Assistant Examiner*—Chi Q Nguyen
(74) *Attorney, Agent, or Firm*—Marshall, Gerstein & Borun LLP

(57) ABSTRACT

An apparatus for connecting adjacent panels includes a first panel and a second panel. Each panel has a connectable edge adapted for connection to a connectable edge of an adjacent panel. At least one first panel interface is disposed on the first panel and at least one second panel interface is disposed on the second panel. Each panel interface is positioned on a surface of the respective panel near the respective connectable edge. First and second interlocking elements are disposed on the respective connectable edges of the panels. The apparatus also includes at least one connector with a base and first and second engaging parts projecting from the base. To connect the panels, the interlocking elements of the connectable edges are interlocked with one another. The connector is mounted to the first and second panels such that the base traverses the connectable edges. The connector is moved such that the first engaging part engages the at least one first panel interface and the second engaging part engages the at least one second panel interface when installed.

20 Claims, 11 Drawing Sheets

U.S. PATENT DOCUMENTS

| | | | | | |
|---|---|---|---|---|---|
| 3,381,430 | A | | 5/1968 | Wiczer | 52/282 |
| 3,436,881 | A | | 4/1969 | Schlecht | 52/92 |
| 3,452,501 | A | | 7/1969 | Zimmer et al. | 52/625 |
| 3,513,608 | A | | 5/1970 | Nagrod | 52/82 |
| 3,516,216 | A | | 6/1970 | Galloway | 52/731 |
| 3,543,456 | A | | 12/1970 | Gregoire | 52/72 |
| 3,593,468 | A | * | 7/1971 | Bustin | 52/27 |
| 3,594,028 | A | * | 7/1971 | Scott | 52/465 |
| 3,638,385 | A | | 2/1972 | Nobels et al. | 52/665 |
| 3,640,039 | A | | 2/1972 | McKee et al. | 52/281 |
| 3,675,380 | A | | 7/1972 | Moss | 52/80 |
| 3,820,299 | A | | 6/1974 | Verholt | 52/753 |
| 3,854,269 | A | | 12/1974 | Hancock | 52/754 |
| 3,866,381 | A | | 2/1975 | Eschbach et al. | 52/731 |
| 3,992,839 | A | | 11/1976 | La Borde | 52/275 |
| 4,104,837 | A | * | 8/1978 | Naito | 52/579 |
| 4,258,519 | A | | 3/1981 | Hugens | 52/282 |
| 4,294,051 | A | | 10/1981 | Hughes, Jr. | 52/228 |
| 4,447,099 | A | | 5/1984 | French et al. | 312/257 |
| 4,557,091 | A | | 12/1985 | Auer | 52/282 |
| 4,652,170 | A | | 3/1987 | Lew | 403/381 |
| 4,790,112 | A | | 12/1988 | Wang | |
| 4,805,365 | A | | 2/1989 | Bastian | 52/282 |
| 5,036,634 | A | | 8/1991 | Lessard et al. | 52/79.1 |
| 5,155,961 | A | | 10/1992 | Bardo | 52/646 |
| 5,184,436 | A | | 2/1993 | Sadler | 52/79.1 |
| 5,331,778 | A | | 7/1994 | Mazpule et al. | 52/79.5 |
| 5,398,909 | A | | 3/1995 | Sandwith | 249/207 |
| 5,413,236 | A | | 5/1995 | Kenevan | 220/4.28 |
| 5,529,423 | A | | 6/1996 | Burke et al. | 403/218 |
| 5,575,119 | A | | 11/1996 | Wolfowitz | 52/79.1 |
| 5,592,794 | A | | 1/1997 | Tundaun | 52/220.7 |
| 5,622,010 | A | | 4/1997 | Weber | 52/36.1 |
| 5,647,181 | A | | 7/1997 | Hunts | 52/282.1 |
| 5,664,380 | A | | 9/1997 | Hsueh | 52/126.4 |
| 5,673,531 | A | | 10/1997 | Carcedo et al. | 52/656.9 |
| 5,694,730 | A | * | 12/1997 | Del Rincon et al. | 52/586.1 |
| 5,724,774 | A | | 3/1998 | Rooney | 52/79.5 |
| 5,775,046 | A | | 7/1998 | Fanger et al. | 52/590.1 |
| 5,813,738 | A | | 9/1998 | Cheng | 312/263 |
| 5,864,997 | A | | 2/1999 | Kelly | 52/282.2 |
| 5,941,026 | A | | 8/1999 | Eisenreich et al. | 52/36.5 |
| D420,838 | S | | 2/2000 | Riga | 248/235 |
| 6,047,663 | A | | 4/2000 | Moreau et al. | 119/529 |
| 6,053,591 | A | | 4/2000 | Kasanic | 312/297 |
| 6,105,794 | A | | 8/2000 | Bauer | 211/94.01 |
| 6,185,878 | B1 | | 2/2001 | Bullard, III et al. | 52/79.5 |
| 6,357,194 | B1 | | 3/2002 | Jones, Jr. | 52/590.1 |
| 2002/0174532 | A1 | | 11/2002 | Skov et al. | |

FOREIGN PATENT DOCUMENTS

| | | |
|---|---|---|
| EP | 0359309 A3 | 3/1990 |
| FR | 1 028 791 | 5/1953 |
| FR | 1 311 988 | 11/1962 |
| FR | 1 447 663 | 6/1966 |
| GB | 938 939 | 9/1963 |
| GB | 1 081 423 | 8/1967 |
| GB | 1 2623 95 | 2/1975 |
| GB | 2115452 A | 9/1983 |
| GB | 2 176 514 A | 1/1986 |
| GB | 2281326 A | 3/1995 |
| IE | 22203 | 7/1959 |
| JP | 4-238954 | 1/1991 |
| WO | WO 91/15681 | 10/1991 |
| WO | WO 02/095167 A1 | 11/2002 |

* cited by examiner

FIG.9
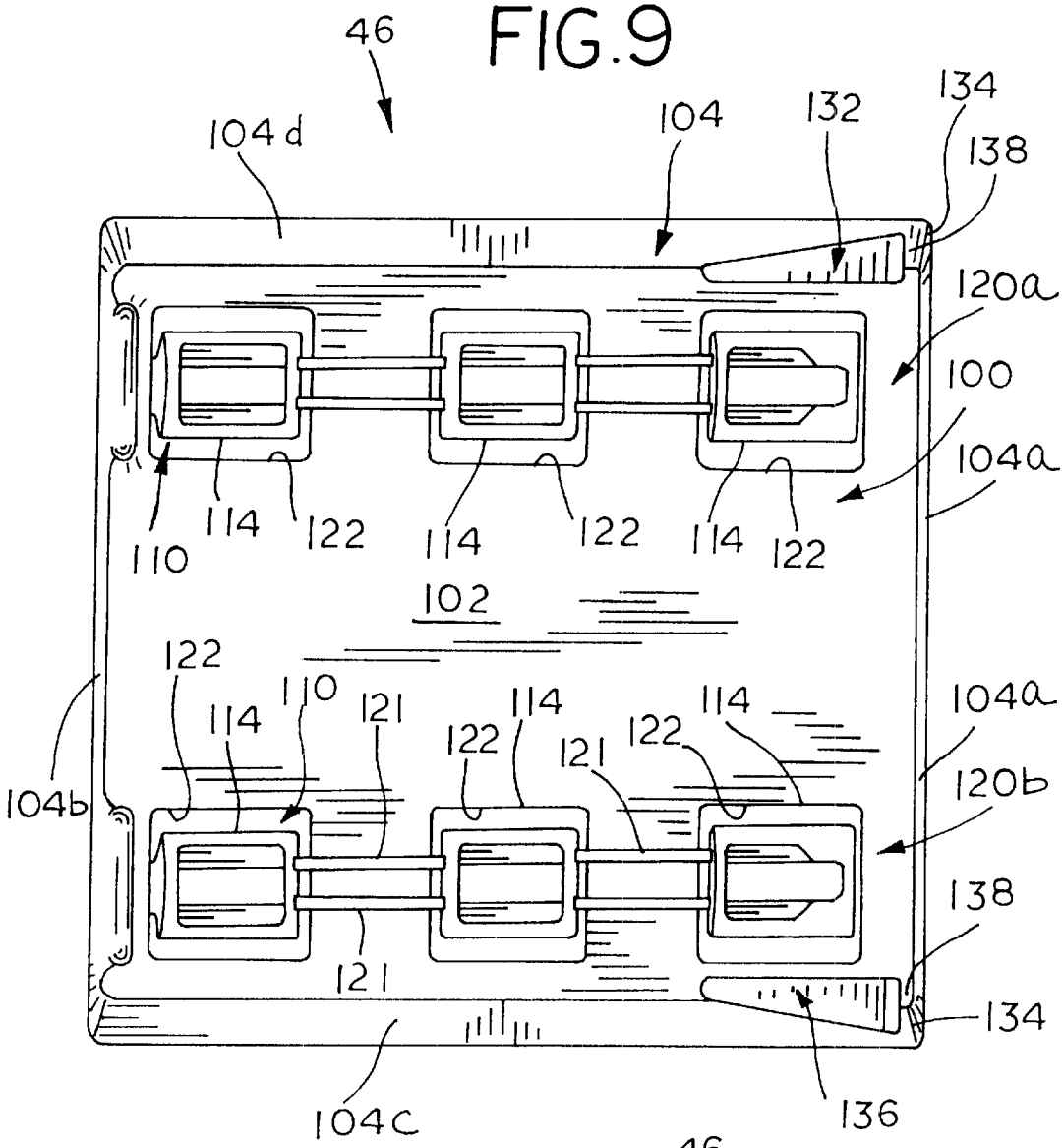
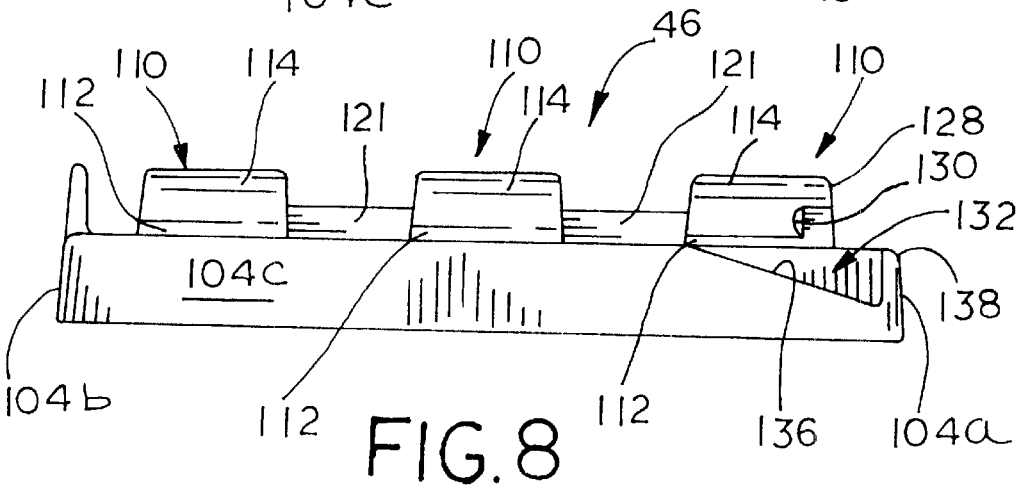
FIG.8

APPARATUS AND METHOD FOR CONNECTING ADJACENT PANELS

RELATED APPLICATION DATA

The present patent is a continuation-in-part of co-pending U.S. patent application Ser. No. 09/860,381, which was filed on May 18, 2001.

FIELD OF THE INVENTION

The invention is generally related to connecting plastic components, and more particularly to an apparatus and a method for interconnecting adjacent plastic panels.

BACKGROUND OF THE INVENTION

Plastic and other panels are used in many different applications for a wide variety of modular or multi-component products. In many of these applications, a plurality of panels and/or components are interconnected to one another to form a finished product assembly. A number of different structures and methods have been devised that are useful to interconnect or attach two adjacent components to one another.

In one example, two adjacent plastic or steel panels may be suitably welded together to form a permanent, water-tight joint at the intersection between the two panels. In another example, each adjacent panel may have a flange wherein the flanges abut or overlap one another when attached. Snap-in-place clips are sometimes used to sandwich or capture the flanges between parts of the clips to secure the flanges together. Alternatively, the abutting flanges may have holes that overlie one another. Standard threaded fasteners or snap-in fasteners can then be passed through the holes to secure the panels together in a known manner. Such fasteners can be fabricated from virtually any suitable material, but are very often formed from metals or plastics.

Problems associated with such connecting methods and structures are abundant. Conventional threaded fasteners result in use of a number of component parts (nuts, bolts, washers, and the like) that require significant labor to install. Small plastic clips and/or plastic snap-in fasteners can easily break or become damaged during installation and during use of the product. The joints formed between flanges of plastic panels tend to be relatively weak and susceptible to bending or breakage when external forces are applied. Such conventional joint structures do not provide for a sturdy combined panel because of the weakness in the joint. Welded joints, whether metal or plastic require significant labor and equipment expense to prepare, form, and cool the welded area. Further, other than the welded joints, such panel connections are not particularly water tight or leak resistant, unless additional elements, such as seals, are added to the joints.

BRIEF DESCRIPTION OF THE DRAWINGS

Exemplary apparatuses and methods in accordance with the teachings of the present invention are described and explained in greater detail below with the aid of the drawing figures in which:

FIG. 8 is a side elevation of one example of a connector constructed in accordance with the teachings of the present invention and illustrated in FIGS. 1–3.

FIG. 9 is a top plan view of the connector shown in FIG. 8.

DETAILED DESCRIPTION OF THE PREFERRED EMBODIMENTS

Figure 1:
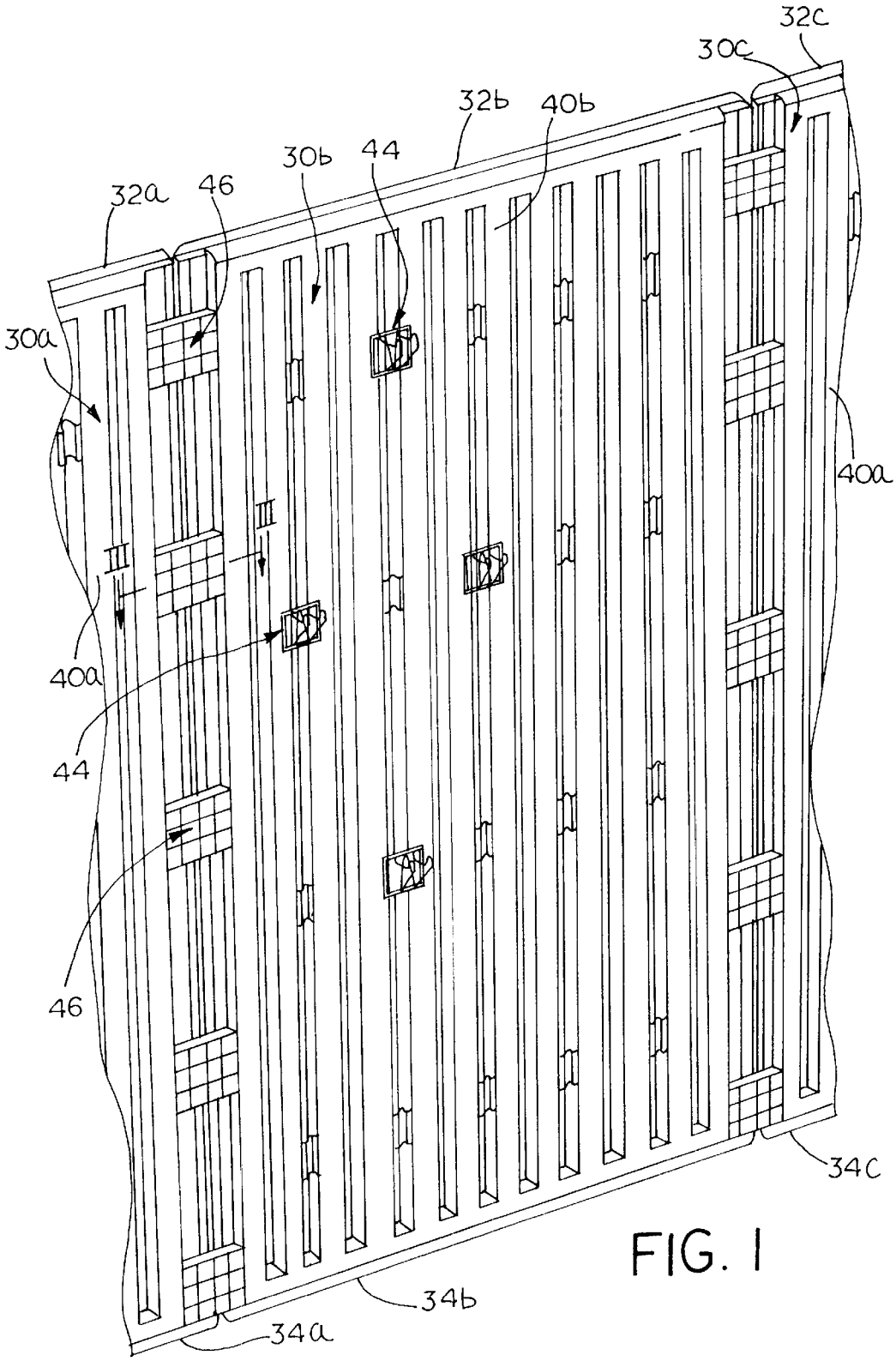
FIG. 1 is a perspective view of one example of a plurality of adjacent panels interconnected in accordance with the teachings of the present invention.

The apparatuses and methods disclosed herein for interconnecting adjacent panels solve or improve upon the above-mentioned problems in the prior art. The apparatuses and methods disclosed are especially well suited for connecting plastic panels, although they can be easily adapted for use with other materials, if desired. A relatively wide connector of substantially rigid and sturdy construction is disclosed and described herein that spans and interconnects two adjacent panels. The connector interlocks with a portion of each of the adjacent panels to secure them together. In addition, each of the panels interlocks with one another to assist in forming the panel joint and to create a water or leak resistant joint. The disclosed interconnecting apparatuses are easy to install and assemble and the methods are easy to utilize.

Also shown in the drawings is an exemplary accessory device for use with the panel construction. The disclosed accessory device is a utility hanger apparatus that mounts to the panels in a simple, efficient manner. The disclosed utility hanger and method to install the hanger generally follow the same principles as the methods and apparatuses described herein for interconnecting the panels. The illustrated accessory device results in a strong, secure, and easy to install utility hanger that can support a wide variety of objects.

In order to simplify the description herein, a general element is given a base reference number. If a number of essentially identical elements are shown or referred to herein, the discrete, identical elements are each given the same base reference number and a unique sub-reference character. As an example, and with reference to FIG. 1, a plurality of interconnected and laterally adjacent plastic panels 30 are illustrated. The panels are generally referred to herein as "panels 30," and are each specifically identified as panels 30*a*, 30*b*, and 30*c* where necessary. In addition, each specific panel has various components and elements associated with that particular panel that are also common to the other panels as well. Such components and elements are similarly identified herein utilizing only the base reference number when generally referring to the object, and utilizing the base reference number and sub-reference character, such as "a" or "b" when referring that object of a specific panel.

Also, terms of orientation, location, or part relationship are used herein, such as "top," "bottom," "front," "back," or other such descriptive terms. Such terms are utilized solely for ease of description and are not intended to specifically limit a component in any way. The panels and other components can be oriented and arranged in virtually any desired manner without being unnecessarily limited or restricted by the use of such terms herein.

As a further preliminary matter, the panels illustrated herein are for a modular shed or storage structure. However, the features of the disclosed examples have a much wider applicability. The panels and the accessory device and its illustrated mounting features can be used for other products including storage devices, units, enclosures, bins, boxes, containers, display panels, boards, totes, and other object storage and organization products. The connectors can be used for any of a variety of containers and the like as well.

The particular materials used to construct the exemplary panels are also illustrative. For example, blow molded, high density polyethylene is one preferred material and method for fabricating the disclosed panels. However, other materials can be used, such as other thermoplastic resins including polypropylene, acrylonitrile butadiene styrene (ABS), polyurethane nylon, homopolymer plastics, copolymer plastics, plastics with special additives, filled plastics, and the like. Also, molding or part forming operations other than blow molding can be used to form the various disclosed components, such as injection molding, rotational molding, and the like.

Further, injection molded, high density polyethylene is a preferred material and method for fabricating the connectors disclosed herein. However, other materials can certainly be used, such as other thermoplastic resins including polypropylene, acrylonitrile butadiene styrene (ABS), polyurethane nylon, homopolymer plastics, copolymer plastics, plastics with special additives, filled plastics, and the like. Still further, other molding operations or part forming operations can be used to form the connector components.

As will be evident to those having ordinary skill in the art, the various parts and components disclosed herein can be formed from other materials such as metal, wood, and the like, if desired and yet fall within the spirit and scope of the present invention. The components can also be fabricated utilizing a variety of manufacturing techniques such as stamping, casting, machining, and the like, as desired.

With the above in mind and with reference to FIG. 1, each of the panels 30 has a top edge 32, a bottom edge 34, a first side edge 36, and a second side edge 38. As described herein, a first side edge 36 of one panel 30 is interconnected or joined to a corresponding second side edge 38 of an adjoining panel. Each of the panels 30 also has a profile side 40 having a surface profile that yields particular characteristics in accordance with the teachings of the present invention. Each of the panels 30 also has what is termed herein as a decorative or cosmetic side 42 that is generally planar. The decorative side 42 need not be adapted to provide particular aesthetics, though in many instances it will be so configured. However, the decorative side 42 does not provide particular features necessary to the apparatus and method as disclosed. One or both of the profile side 40 and the decorative side 42 can be adapted to include features that add rigidity or enhance the structural characteristics of the panels, if desired, though not disclosed herein.

Figure 2:
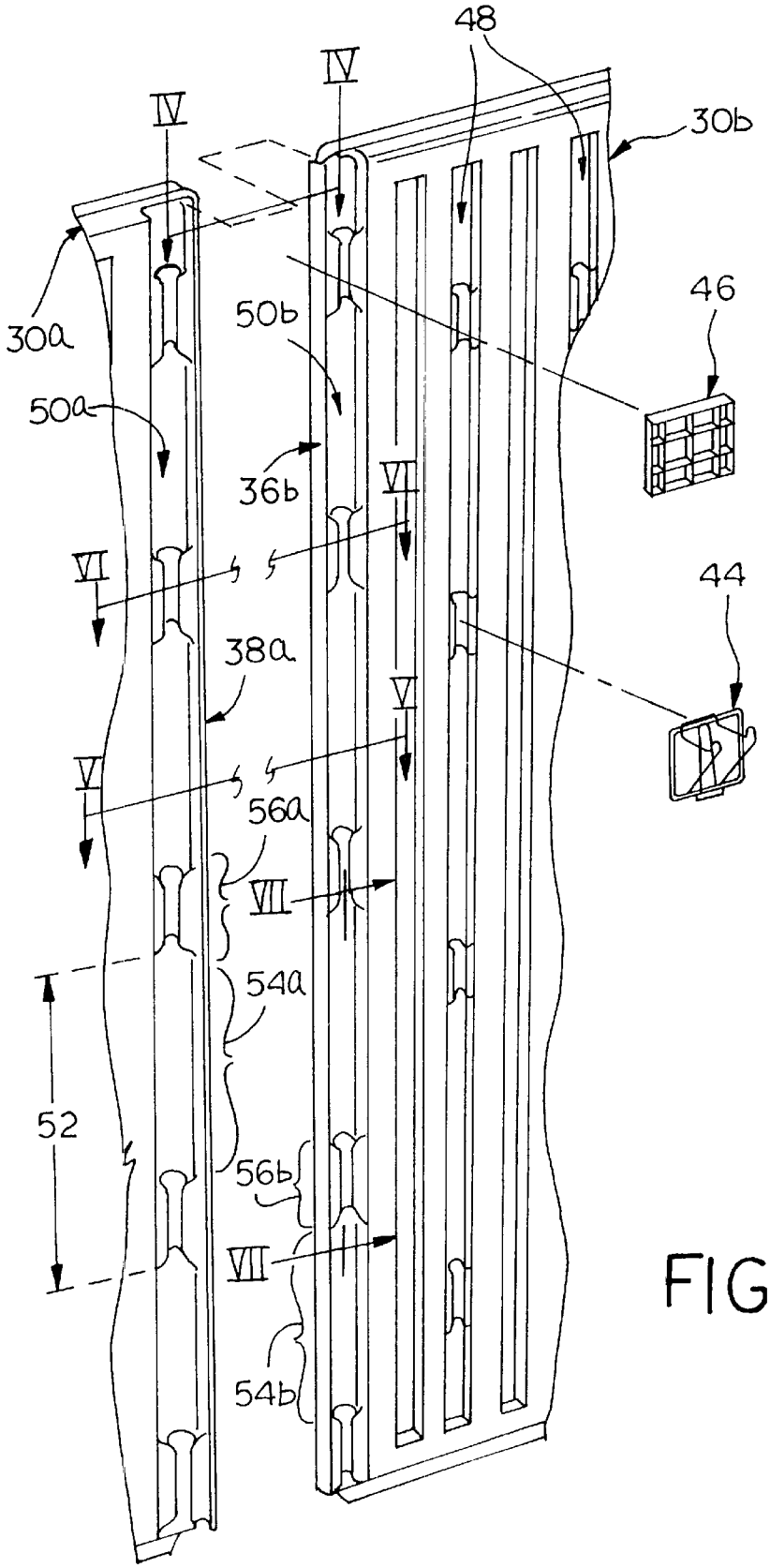
FIG. 2 is an exploded view of two of the interconnected panels as shown in FIG. 1.

In the disclosed example, one or more accessory devices in the form of utility hangers 44 can be mounted to the profile side 40 of each panel. The accessory devices can be added to perform any number of desired functions, such as to provide shelving supports, tool hangers, and the like. As shown in FIG. 2, the utility hangers 44 or other accessory devices can be assembled to numerous different locations as desired on the profile side 40 of a given panel 30.

Details of the various structures and methods in accordance with the teachings of the present invention are now described. In general, a pair of adjacent panels, such as the panels 30*a* and 30*b*, can be interconnected by one or more connectors 46 that engage a portion of the profile side 40 of each adjoining panel. The adjacent panels 30*a* and 30*b* are first attached or interlocked with one another and then secured or connected to one another utilizing one or more of the connectors 46.

As shown in FIGS. 1 and 2, each panel 30 includes at least one connector interface to accept and engage with one of the connectors 46. In the disclosed example, the panels 30 each have a connector interface in the form of an elongate connector channel 50 disposed adjacent each of the side edges 36 and 38. In an alternative example, each panel can have a connector interface, such as a connector channel 50, disposed adjacent only one of the opposed side edges 36 or 38 so that only one of the panel edges is adapted to be joined to an adjacent panel. Depending upon the particular panel construction, a connector interface or channel 50 can be disposed adjacent any or all side, top, bottom, or other edges of a panel, as desired.

As illustrated in FIGS. 1 and 2, each connector channel 50 is a continuous channel having a plurality of discrete channel segments 52. Alternatively, each connector channel 50 can be discontinuous or segmented and define intermittent, discrete channel segments 52 along an appropriate edge of the panel. In another alternative, a connector interface of channel 50 may include only a single segment, as such segments are described herein. Each segment 52 of each channel 50 in the disclosed example has a connector docking section 54 that is adapted for insertion and removal of a portion of a connector 46. Each segment 52 also has a connector engaging section 56 that is adapted for connector installation when securely joining two adjacent panels. Each channel segment is adapted to accommodate, in this example, part of one of the connectors 46 as described below. Details of the channel segments 52 and sections 54 and 56 are also described in greater detail below.

Figure 3:
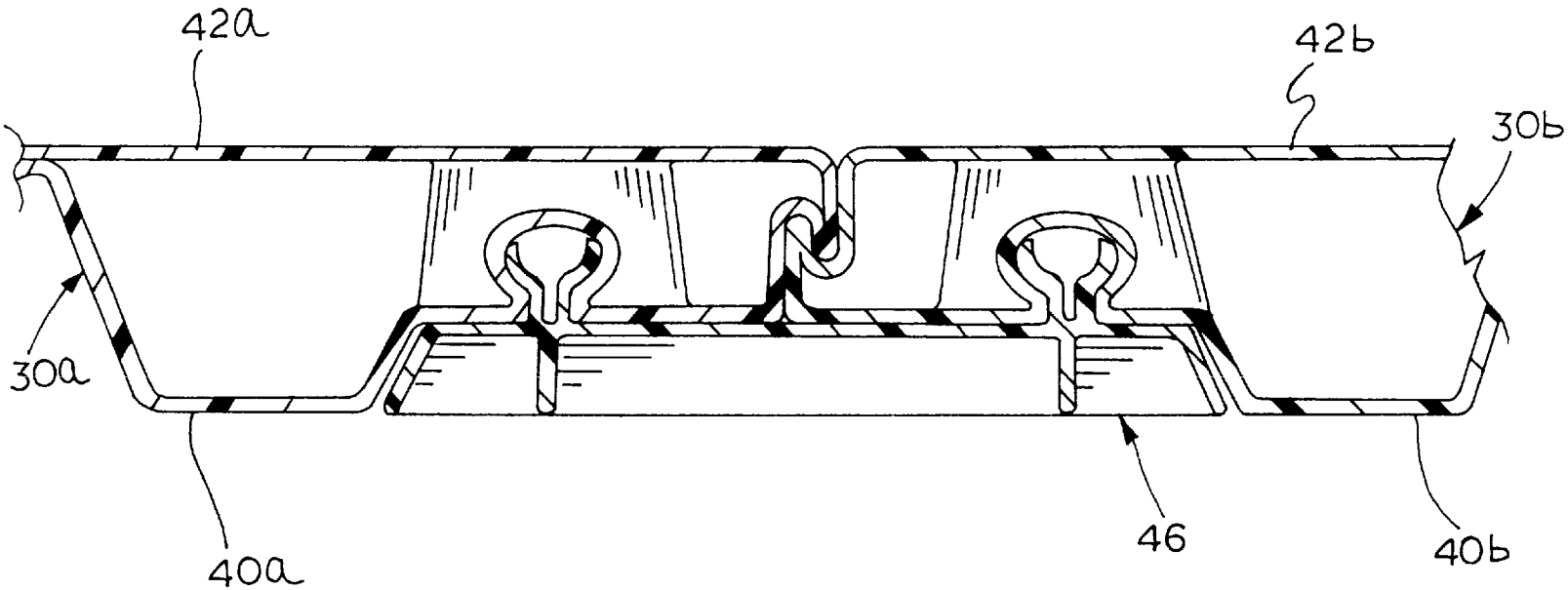
FIG. 3 is a transverse cross section across an interconnected joint between two of the adjacent panels and taken along line III—III of FIG. 1.

As shown in FIG. 3, an apparatus as constructed and engaged in accordance with the teachings of the present invention generally utilizes at least one of the connectors 46 and at least a pair of the connector channel segments, one from each of the two adjacent panels. In this example, the panels 30*a* and 30*b* and thus, a segment 52*a* and 52*b*, are utilized for the engaged apparatus. One of the segments is provided on each of two adjacent panels 30*a* and 30*b* to be connected.

Figure 4:
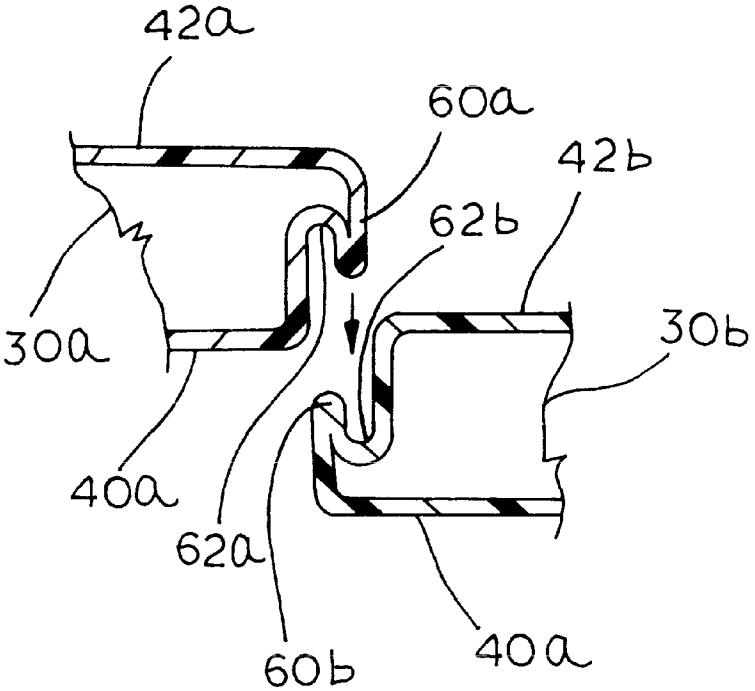
FIG. 4 is a transverse cross section of the two adjacent panel edges shown just prior to attachment to one another and taken generally along line IV—IV in FIG. 2.

Details of both the method and the apparatus in accordance with the teachings of the present invention are described, beginning with reference to FIG. 4. Each of the panels has an interlocking element at all of the edges that are adapted to interconnect with an adjacent panel. The interlocking elements of the panels to be joined are first interlocked to one another. Then a connector is utilized to secure the adjacent panels together.

Figure 5:
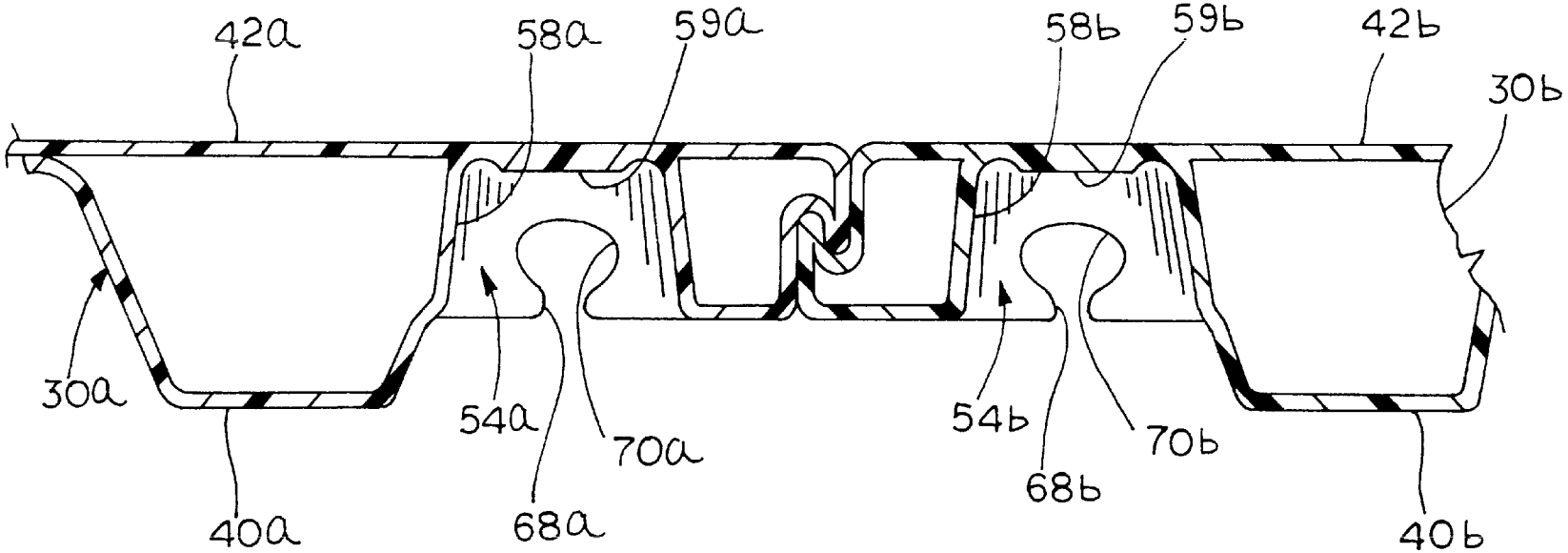
FIG. 5 is a transverse cross section of the joint between the two panel edges shown just after attachment to one another, shown prior to installation of the connector, and taken along line V—V in FIG. 2.

In this disclosed example, each adjacent panel edge to be joined, such as the side edges 38*a* of the panel 30*a* and 36*b* of the panel 30*b*, has an interlocking lip 60*a* and 60*b*, respectively, that extends from the corresponding panel edge. Each lip 60 extends from the panel edge at an angle, and in this example, is generally perpendicular to a plane of the corresponding panel. Each lip 60*a* and 60*b* defines a groove 62*a* and 60*b*, respectively, between the lip and the panel edge. The lips 60 and grooves 62 of the respective panels are arranged in opposite directions so that the lip of one panel is received in and engages the groove of the adjacent panel in an interlocking relationship. For example, as shown in FIGS. 4 and 5, the lip 60*a* of the panel 30*a* is received in the groove 62*b* of the panel 30*b*. Similarly, the lip 60*b* is received in the groove 62*a*.

Once the two adjacent panels, such as the panels 30*a* and 30*b*, are engaged or interlocked in this manner, the two panels, and thus the channels 50*a* and 50*b* are properly spaced apart laterally across the joint. However, the two panels 30*a* and 30*b* should also be aligned longitudinally so as to accommodate installation of a connector 46. In the disclosed example, the connector 46 requires that the corresponding docking sections 54*a* and 54*b* and engaging sections 56*a* and 56*b* of the adjacent channels 50*a* and 50*b* be directly across from one another. In an alternative example, though not shown or described in detail herein, the connector 46 can be designed to require a different, non-mirror image alignment of the adjacent channels 50, if desired.

Figure 6:
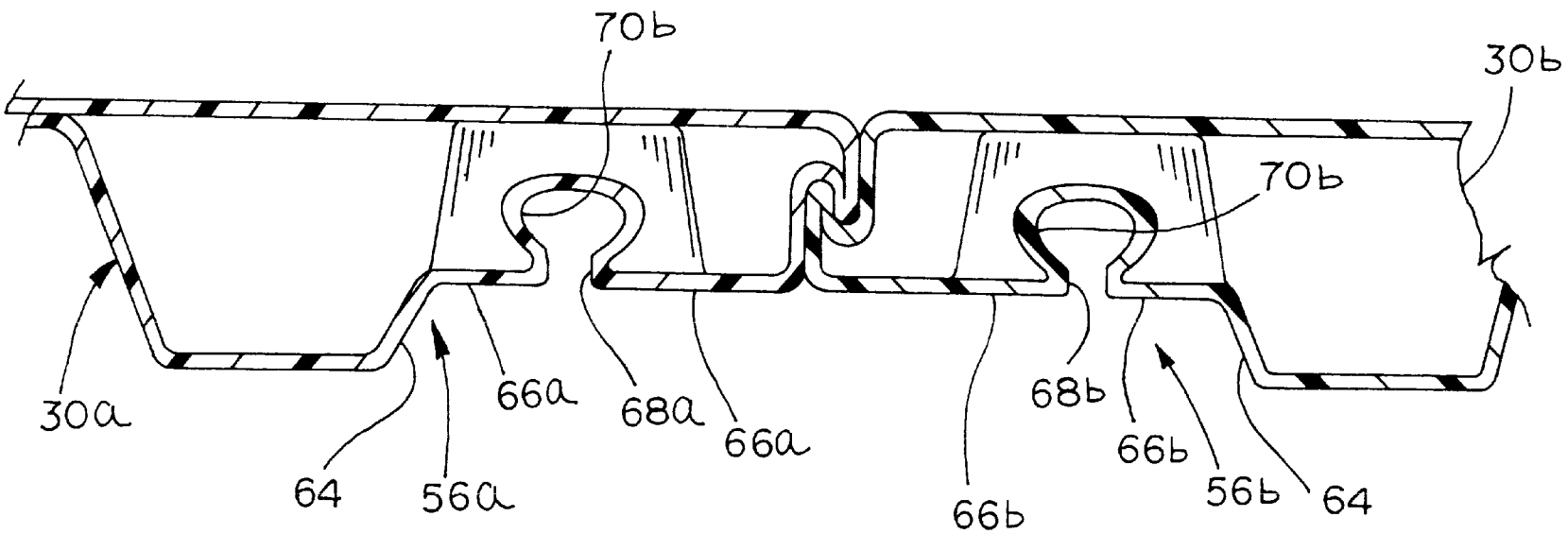
FIG. 6 is a transverse cross section of the joint between the two panel edges shown just after attachment to one another, shown prior to installation of the connector, and taken along line VI—VI in FIG. 2.
Figure 7:
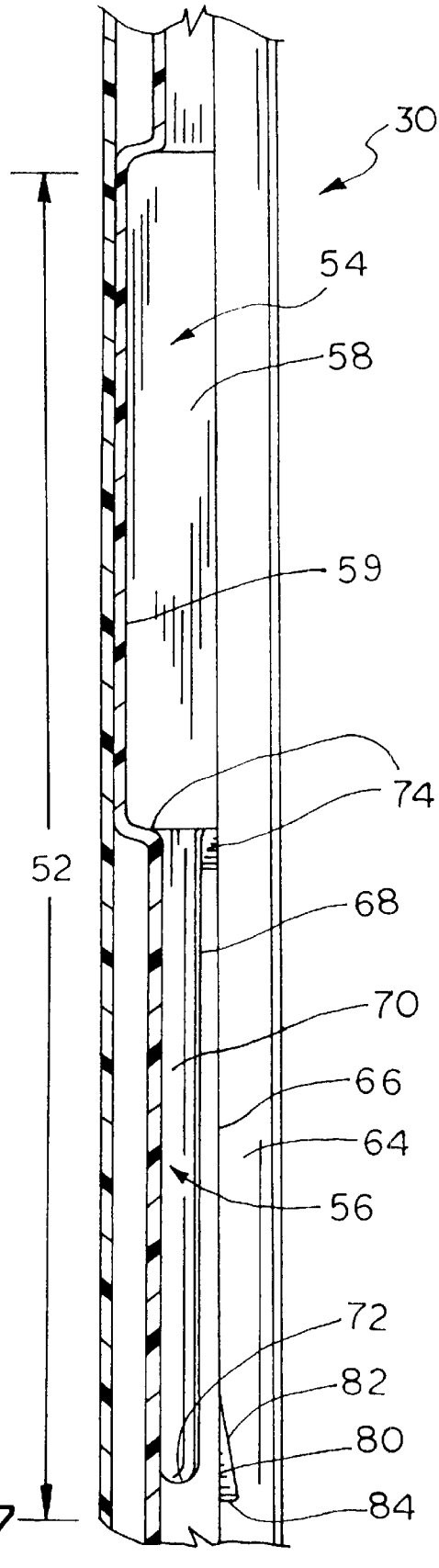
FIG. 7 is a longitudinal cross section of a connector receiving slot of one panel and taken along line VII—VII in FIG. 2.

Details of the channel segments 52 are described with particular reference to FIGS. 5–7. FIG. 5 illustrates a transverse cross section across two engaged panels 30*a* and 30*b* prior to installation of a connector 46, and taken through the properly longitudinally aligned (side-by-side) connector docking sections 54*a* and 54*b*. As shown, each docking section 54 of each channel has a pair of side walls 58 and a bottom wall 59 that define a depth and a width intended to easily accommodate insertion of a connector therein. A connector 46 is placed into the profile side 40 of the engaged panels 30 at the docking sections 54 and readied for installation. In the present example, each docking section 54 also has a length, as illustrated in FIG. 7, that extends between longitudinally adjacent engaging sections 56 of two channel segments 52 in the channel 50. As discussed above, each docking section need not extend continuously to another channel segment, but instead may terminate at a discrete segment end (not shown) if desired. In any case, the docking section 54 must have a length, width, and depth combination that permits adequate insertion of a connector 46 into the docking section to facilitate proper installation and engagement of the connector.

FIG. 6 illustrates a transverse cross section across two engaged panels 30*a* and 30*b*, prior to installation of a connector 46, and taken through the side-by-side connector engaging sections 56*a* and 56*b*. Each connector engaging section 56 of a channel 50 has side walls 64 and a generally planar bearing surface 66. A connector slot 68 is provided in the bearing surface 66 and extends longitudinally along the length of the connector engaging section 56. The connector slot 68 provides access deeper into the engaging section, and particularly, into a connector latching tunnel 70. The width of the connector slot 68 is narrower than the width of the latching tunnel 70 for reasons described in greater detail below. One end of the latching tunnel narrows to define a connector stop surface 72, limiting the travel of a connector when installed. The opposite end of the latching tunnel 70 and connector slot 68 can be tapered slightly radially outward, as shown, to define an entry opening 74 into the connector slot and latching tunnel.

The connector interface of one or both of the adjacent panels can include a detente mechanism to provide a positive fully installed feel or indication. The detente mechanism can also assist in holding a connector in an installed position. In this example, a detent ramp 80 is provided on at least one of the bearing surfaces 66 adjacent the connector slot 68. In the present example, a ramp 80 is provided on the side of the bearing surface 66 furthest from the panel edge so that when the connector 46 is installed, its outer most forward edges each engage a detent ramp to assist in holding the connector in the installed or engaged position. In the present example, the detent ramps 80 each have an inclined ramp surface 82 that can be inclined at a desired angle to make installation of the connector relatively easy. The ramps 80 in this example are located near the forward, narrowed end or stop surfaces 72 of the latching tunnel 70. However, the ramps can alternatively be provided anywhere along the bearing surfaces and yet provide the attendant function. Each ramp surface terminates at its inclined end at a front end 84.

Referring now to FIGS. 8–11, one example of the connector 46 is shown and described. However, as will be evident to those having ordinary skill in the art, many modifications and changes to the disclosed connector 46 can be made without departing from the spirit and scope of the present invention. The connector 46 generally has a base and a pair of engaging parts projecting from the base. The base is sized to span between or traverse the two adjacent panels and to reach the connector interface of each panel. The engaging parts are positioned and constructed such that one of the parts engages with each of the connector interfaces of the panels.

The disclosed connector 46 has a body or base 100, which in this example is generally rectangular, and nearly square. The disclosed base 100 is a molded thermoplastic component having a wall thickness and a structural design sufficient to render the base substantially rigid. In the present example, the base has a top wall or surface 102, an annular depending skirt 104, which in this example is in the form of a plurality of depending skirt walls 104*a*, 104*b*, and 104*c*, and 104*d* necessitated by the polygonal shape of the base. The wall 104*a* is positioned at a leading end of the connector 46 and the wall 104*b* is positioned at a trailing end. The walls 104*c* and 104*d* define sides of the connector. The height of the annular skirt or side walls 104 creates a bottom well or depression 106 in the connector 46. A plurality of structural ribs 108 extend both longitudinally and transversely across the well 106 to provide additional structural rigidity to the connector 46 while minimizing the weight of the part and the amount of material necessary to form the part. The bottom well 106 and the ribs 108 of the base 100 are shown in simplified form in FIGS. 1 and 2, as well as in greater detail in FIG. 3.

The engaging parts of the connector 46 in this example each include a plurality of discrete engaging or locking pins 110 that extend generally perpendicular from the top wall 102. Each of the locking pins 110 has a narrow stalk section 112 connecting the pin to the base and an engagement head 114 spaced from the top wall by a respective stalk. The transverse width of the stalk essentially corresponds to the width of the connector slot 68 described previously for the channels 50. Similarly, the size and contour of the heads 114 correspond in size and shape to the cross sectional shape of the connector tunnel 70. In the present example, the pins 110 are open at the top and thus have a partly open interior 116 to reduce the weight of the part and to reduce the amount of material needed to fabricate the part.

The pair of engaging parts of the disclosed connector 46 are arranged as a pair of pin rows 120*a* and 120*b* disposed adjacent and arranged along the opposite edges or sides of the connector 46. Each pin row 120 can alternatively be replaced by a unitary elongate structure or engaging part with no discrete segments or pins, if desired. Elongate strengthening ribs 121 are arranged parallel to and spaced apart from one another and extend longitudinally between the discrete pins 110 in each of the rows 120*a* and 120*b*.

Suitable recesses, openings, and the like can be provided such as the openings 122 in the connector 146. Such features may be necessary or advantageous when molding or otherwise forming the connector. As will be evident to those having ordinary skill in the art, the shape, construction, and various features of the pins and base can vary considerably and yet fall within the scope of the present invention.

Figure 10:
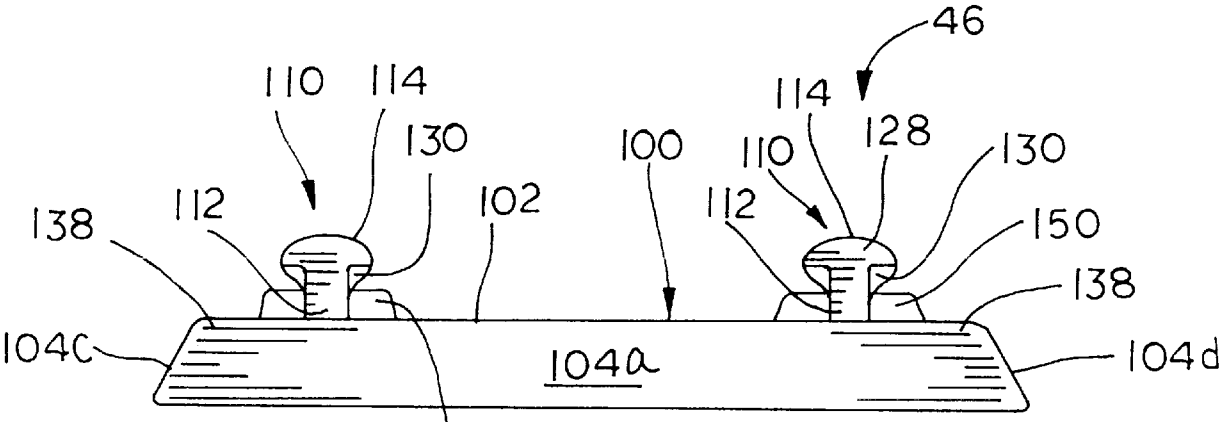
FIG. 10 is a forward end view of the connector shown in FIG. 8.

As shown in FIGS. 8 and 10, a forward or leading end 124 of the connector 46 has additional features that are not found on the trailing or rear end 126 of the connector. For example, the forward facing ends 128 of the forward most pins 110 include notches or cutouts 130. The notches are disposed in a lower portion of the head 114 near the stalk 112. The notches 130 effectively narrow the leading end of each row 120 of pins 110 for ease of installation as described in greater detail below.

Similarly, a recess 132 is provided near each forward corner 134 of the base 100. Each recess 132 has an inclined surface 136 and a front detent barrier wall 138. The recesses 132 are open both to the top wall 102 and the skirt or side walls 104*c* and 104*d*. However, each recess is closed off toward the front wall or skirt 104*a* by a part of the front wall that defines the detente barrier wall 138 for reasons described below.

Figure 11:
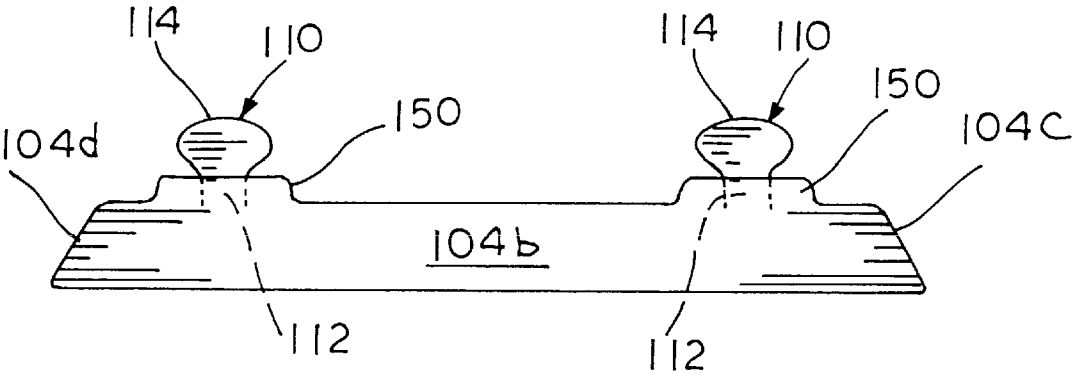
FIG. 11 is a rear end view of the connector shown in FIG. 8.

FIG. 11 simply illustrates a rear elevation of the disclosed exemplary connector 46. The general contour of the pins 110 including the stalks 112 and heads 114 of the trailing pins 110 in each row 120*a* and 120*b* can be seen. One or more upstanding ribs 150 can optionally be placed at the leading end 124, extending from the base 102. One rib 150 is shown in front of each of the engaging pin rows 120. The ribs 150 or other such barrier mechanism can be used to prevent reverse installation of the connector 46, if desired.

Figure 12:
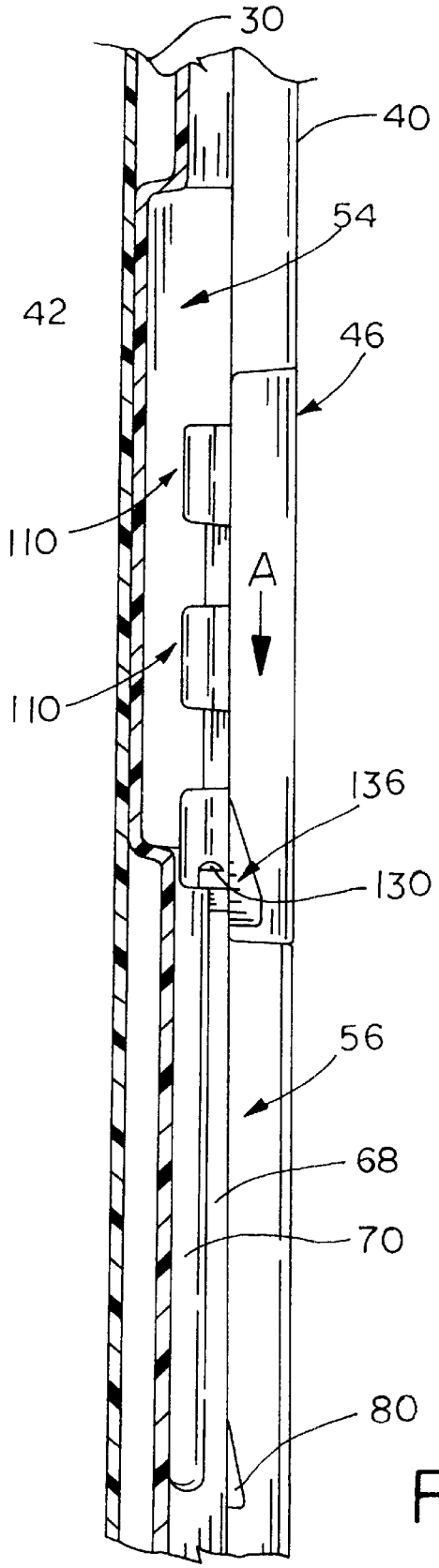
FIG. 12 is a side view in partial longitudinal cross section of the connector slot of FIG. 5 with the connector of FIG. 8 shown just prior to installation.
Figure 13:
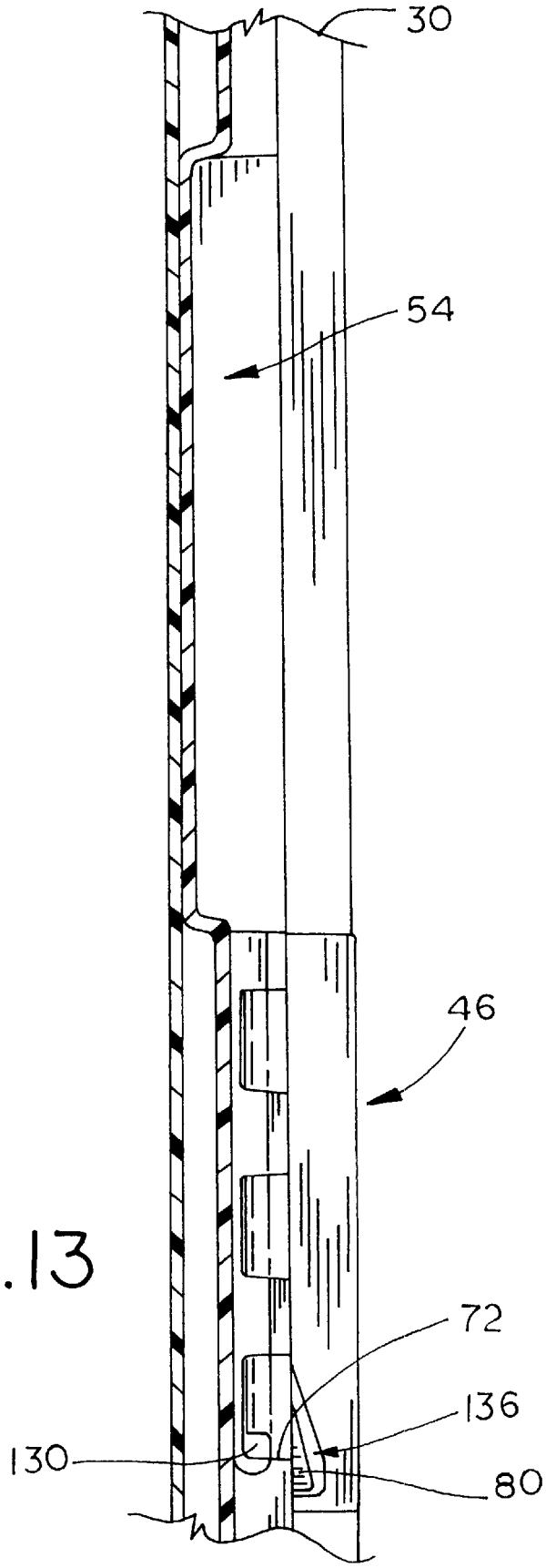
FIG. 13 is a side view of the connector slot shown in FIG. 12 after full installation of the connector.

The procedure for installing a connector 46 in order to interconnect two adjacent panels 30, and the corresponding component features, are now described with particular reference to FIGS. 12 and 13. First, two adjacent panels, such as the panels 30*a* and 30*b*, are oriented and placed with the edges 38*a* and 36*b* (or the edges intended for connection) adjacent one another. The panels are then longitudinally aligned as needed to accommodate and receive the selected connector 46. The lips 60*a* and 60*b* and grooves 62*a* and 62*b* are then interlocked as described above and shown in FIGS. 4 and 5.

A connector 46 is then selected and oriented with the pins 110 facing the profile sides or surfaces 40*a* and 40*b* of the interlocked panels 30*a* and 30*b*. The connector is also oriented such that the connector leading end 124 generally faces toward the connector slot 68 and tunnel 70 into which the connector is to be installed. The pins 110 are then moved directly over the connector channels 50 and 50 of the panels. One row 120*a* of pins 110*a* is inserted into the docking section 54*a* of the channel 50*a* and the other row 120*b* of pins 110*b* is inserted into the docking section 54*b* of the channel 50*b* as shown in FIG. 12. In this pre-installation position, the pins 110 and base 100 essentially float freely within the docking sections 54 of the channels 50. The center part of the connector base wall 102 can be designed rest or bear against portions of the panels 30*a* and 30*b* between the channels 50*a* and 50*b*, if desired. These regions of the panels can be sized to precisely vertically position the connector relative to the depth of the channels.

To complete installation of the connector 46, the connector is moved in the direction of the arrow "A" toward the engaging sections 56*a* and 56*b*, as shown in FIG. 12. The notches 130 on the pin leading ends and the tapered entry 74 into the connector slot 70 each assist in guiding the heads 114 and stalks 112 of the pins 110 into and between edges of the tunnel 70 and slot 68, respectively. The heads 114 are then guided along the tunnel 70 by the close fitting and complimentary relationship between the heads and tunnels. The heads 114*a* move into and along the tunnel 70*a* and the heads 114*b* move into and along the tunnel 70*b*. Similarly, the stalks 112*a* and 112*b* travel along the connector slots 68*a* and 68*b*, respectively. The slot width and stalk width are preferably sized to provide a close fit between the parts.

As the recesses 132 approach the ramps 80, the detente barrier walls 138 ride up the ramp surfaces 82. When the detente barriers 138 reach the forward or front ends 84 of the ramps 80, the barriers 138 snap over the forward ends to capture the ramps in the recesses 132. The angle of the inclined surfaces 136 of the recesses 132 preferably match the angle of the ramp surfaces 82. The detente structure assists in longitudinally holding the connectors in place. The dimensions of the slot 68, stalks 112, tunnels 70, and heads 114 can also be such that static friction created between tightly fitting components also assists in holding the connectors in place. When the connectors 46 are installed, the relatively large size of heads 114 and the narrow width of the slots 68 retain the connectors in the installed position.

The forward ends 84 of the ramps and the inner sides of the detente barriers 138 that face the ramps, when the connector is installed, are preferably drafted, angled, or rounded slightly to assist in removing the connector 46 when desired. To remove the connector, the reverse of the above-described process is performed, but the detente barriers 138 must first snap back over the ramps 80 to accomplish removal.

Various dimensions for certain parts of the apparatus described herein can be selected to achieve desired functional characteristics. For example, if the panels 30 and connectors 46 are formed from plastic or thermoplastic materials, the parts can be designed to create slight interference fits or slight loads at points within the apparatus. The pins and/or the tunnels and slots can be appropriately spaced to draw the adjacent panels slightly together or force them slightly apart when installing the connector to create a fairly rigid joint or to form a seal at the lip and groove joint. Similarly, the detente barriers, ramps, and/or other elements can also be varied to achieve certain functional characteristics. Also, the tunnel, head, stalk, and slot sizes, and shapes, and positions can be designed to create desired characteristics. As an example, the engaging parts such as the pins can be formed progressively larger, moving from the leading end to the trailing end of the connector 46.

The disclosed panels 30 are particularly well suited for the method and apparatus. The panels are hollow panels with space between the profile sides 40 and decorative sides 42. Molding tools and operations can be utilized to form a wide variety of shapes and features into the panels. Points where the profiles side 40 and decorative side 42 are joined (called "tack offs"—see FIG. 12 at the bottom 59 of the docking section 54) can be created to provide strength enhancing characteristics as well as other features.

Although certain methods and apparatuses have been disclosed and described herein in accordance with the teachings of the present invention, the scope of coverage of this patent is not limited thereto. On the contrary, this patent covers all embodiments of the teachings of the invention fairly falling within the scope of the appended claims, either literally or under the doctrine of equivalents.

What is claimed is:

1. An apparatus connecting adjacent panels comprises:

a first panel and a second panel, each panel having a connectable edge adapted for connection to a connectable edge of the other panel;

at least one first panel interface disposed on the first panel and at least one second panel interface disposed on the second panel, each panel interface positioned on a surface of the respective panel near the respective connectable edge;

first and second interlocking elements disposed on the respective connectable edges of the first and second panels, the interlocking elements being interlocked with one another; and at least one connector having a base and first and second engaging parts projecting from the base, wherein the connector is mounted to the first and second panels such that the base traverses the connectable edges with the first engaging part engaged with the at least one first panel interface and with the second engaging part engaged with the at least one second panel interface when the connector is installed.

2. An apparatus according to claim 1, wherein the first and second panels each have a profile side, a decorative side, and a perimeter edge that defines the respective connectable edge.

3. An apparatus according to claim 2, wherein the profile side of the first panel and the second panel has a varied surface profile that forms the at least one respective panel interface.

4. An apparatus according to claim 1, wherein the at least one first and second panel interfaces each further comprise:

an elongate channel segment extending generally parallel to the respective connectable edge, the channel segment having a docking section for initial insertion of the connector into the channel, and having an engaging section for engaging one of the engaging parts of the connector.

5. An apparatus according to claim 4, wherein the engaging section of each channel further comprises:

an engaging tunnel extending longitudinally along the channel and having a shape and a tunnel width that is complimentary to a respective one of the engaging parts of the connector;

a connector slot extending longitudinally along the channel and opening into the engaging tunnel and having a slot width that is smaller than the tunnel width; and an entry opening at one end of both the engaging tunnel and the connector slot permitting installation of the respective one of the engaging parts into the engaging tunnel and connector slot.

6. An apparatus according to claim 1, wherein the panel interface on each of the first and second panels includes at least one detente mechanism that engages when the connector is installed.

7. An apparatus according to claim 6, wherein the detente mechanism comprises:

a ramp provided on a part of the panel interface; and a recess provided on a part of the connector that engages with the ramp when the connector is installed.

8. An apparatus according to claim 1, wherein the engaging parts of the connector further comprise:

a stalk projecting from the base and having a stalk width; and a head disposed on the stalk and spaced from the stalk, wherein the head has a head width that is larger than the stalk width.

9. An apparatus according to claim 8, wherein each of the engaging parts further comprises:

a row of discrete spaced apart pins each having such a stalk and head configuration.

10. An apparatus according to claim 1, further comprising:

a plurality of first and second panel interfaces provided on each of the first and second panels near the respective connectable edges; and a plurality of connectors, one each for each pair of corresponding first and second panel interfaces.

11. An apparatus according to claim 1, further comprising:

a plurality of connectable edges provided on each of the first and second panels.

12. An apparatus according to claim 1, wherein the first and second interlocking elements comprise:

first and second lips extending from the respective first and second connectable edges, the first and second lips each being oriented at an angle relative to a plane of the respective first and second panels and that is complementary to the angle of the other lip.

13. An apparatus according to claim 12, wherein the first and second lips form respective first and second grooves between the corresponding connectable edge and lip, and wherein the first lip is received in the second groove and the second lip is received in the first groove when the first and second lips are interlocked.

14. An apparatus according to claim 1, wherein the first and second panels are hollow panels formed from a thermoplastic material.

15. An apparatus according to claim 1, wherein the at least one connector is molded from a high density thermoplastic material.

16. An apparatus according to claim 1, wherein the first and second panels further comprise:

accessory panel interfaces for mounting accessory devices to the panels.

17. A method of connecting adjacent panels comprises the steps of:

providing first and second panels respectively having at least one first and second connectable edge, the first panel having at least one first panel interface and the second panel having at least one second panel interface, the panel interfaces positioned on a surface of the respective panels near the respective connectable edges, and the first and second panels having respective first and second interlocking elements disposed on the respective first and second connectable edges;

placing the first and second connectable edges adjacent one another;

interlocking the first and second interlocking elements with one another;

selecting at least one connector having first and second engaging parts adapted to cooperate with the first and second panel interfaces;

inserting the first engaging part into the first panel interface and inserting the second engaging part into the second panel interface; and moving the connector to engage the first and second panel interfaces and the first and second engaging parts.

18. A method according to claim 17, wherein the step of moving the connector further comprises:

moving the connector until a detente mechanism engages between the connector and the first and second panel interfaces.

19. A method according to claim 17, wherein the step of moving further comprises:

moving the connector from first and second docking sections of the respective first and second panel interfaces to first and second engaging sections of the respective first and second panel interfaces.

20. A method according to claim 17, wherein the step of inserting further comprises:

inserting the connector into first and second docking sections of the respective first and second panel interfaces.

* * * * *